US007402071B2

(12) United States Patent
Ohtaka et al.

(10) Patent No.: US 7,402,071 B2
(45) Date of Patent: Jul. 22, 2008

(54) CONNECTOR SYSTEM HAVING A CONNECTION DETECTING MECHANISM

(75) Inventors: Kazuto Ohtaka, Shizuoka (JP); Toshiharu Takahashi, Shizuoka (JP); Shigeru Tanaka, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/518,561

(22) Filed: Sep. 12, 2006

(65) Prior Publication Data

US 2007/0059968 A1 Mar. 15, 2007

(30) Foreign Application Priority Data

Sep. 12, 2005 (JP) ..... 2005-263772

(51) Int. Cl.
*H01R 13/627* (2006.01)

(52) U.S. Cl. ..... 439/357; 439/489

(58) Field of Classification Search ..... 439/357, 439/489, 507, 188
See application file for complete search history.

(56) References Cited

U.S. PATENT DOCUMENTS 5,464,353 A * 11/1995 Saijo et al. ..... 439/489
5,588,872 A * 12/1996 Fukuda ..... 439/489
5,647,754 A * 7/1997 Kohno ..... 439/188
5,997,344 A * 12/1999 Shinozaki ..... 439/489
6,705,881 B2 * 3/2004 Tsuchiya ..... 439/157
6,783,388 B2 * 8/2004 Matsushita ..... 439/489
6,827,596 B2 * 12/2004 Hori ..... 439/188

FOREIGN PATENT DOCUMENTS

JP 8-22873 1/1996

* cited by examiner

*Primary Examiner*—Hae Moon Hyeon
(74) *Attorney, Agent, or Firm*—Kratz, Quintos & Hanson, LLP

(57) ABSTRACT

Providing a connector system, which can detect securely connection of connector housings, the connector system includes a first connector and a second connector. The first connector includes a first connector housing, on an outer surface of which a lock projection and a pair of electrodes are provided. The second connector includes a second connector housing having a main body, a lock arm and a shorting member. The lock arm supported by the main body is engaged with the lock projection. One end portion of the shorting member is mounted on the main body, and the other end is formed like a free end of a cantilever. The other end has a contact point. When the connector housings are fitted together, the contact point and lock projection are arranged in a direction perpendicular to a fitting direction.

6 Claims, 9 Drawing Sheets

CONNECTOR SYSTEM HAVING A CONNECTION DETECTING MECHANISM

The priority application Number Japan Patent Application 2005-263772 upon which this patent application is based is hereby incorporated by reference.

BACKGROUND OF THE INVENTION

1. Field of the Invention

This invention relates to a connector system for connecting electric wires.

2. Description of the Related Art

Various electronic devices are mounted in a car as a vehicle. Wiring harnesses are wired in the car for transmitting electric power and control signals to the electronic devices. Each wiring harness includes a plurality of electric wires and a plurality of connectors (refer Patent Document 1). The electric wire has a conductive core wire and an insulating cover for covering the core wire, that is a covered wire.

The connector described in Patent Document 1 includes a first connector housing having a pair of electrodes for detecting connection and a lock arm and a lock projection on an outer surface thereof an a second connector housing having a lock arm to be engaged with the lock projection and a conductive shorting member for shorting (connecting electrically) the pair of electrodes to each other when the lock arm to be engaged with the lock projection is engaged with the lock projection.

According to the connector, the conductive shorting member shorts the pair of electrodes when the first and second connector housings are fitted to each other. Thereby, fitting the connector housings to each other in normal condition can be detected by a connection detecting circuit formed with the pair of electrodes. Patent Document 1 is the Japan Published Patent Application No. H08-28873.

SUMMARY OF THE INVENTION

Objects to be Solved

According to the connector shown in Patent Document 1, contact points of the shorting member and the pair of electrodes and the lock projection are arranged at positions shifted along a direction of fitting the connector housings (a direction to move the connector housings close to each other when fitting them). In other words, the contact points and the lock projection are not arranged along a direction perpendicular to the direction of fitting the connector housings.

Thereby, when the shorting member is slightly deformed into an unexpected shape, the shorting member may not short the pair of electrodes even if the lock projection and the lock arm are engaged normally, or the shorting member may short the pair of electrodes even if the lock projection and the lock arm are not engaged normally.

Thus, according to the connector shown in Patent Document 1, since the shorting member, the pair of electrodes and the lock projection are arranged at positions shifted to each other along the direction of fitting the connector housings, it is difficult to detect securely engagement of the lock projection and the lock arm.

One object of the present invention is to provide a connector system which can detect securely fitting of the connector housings to each other. How to attain the object of the present invention In order to overcome the above problems and attain the object of the present invention, a connector system is characterised in that the connector system includes a first connector housing having a pair of electrodes for detecting connection and a lock projection on a outer surface thereof and a second connector housing, fitting to the first connector housing, which has a lock arm to be engaged with the lock projection, a main body supporting the lock arm and a shorting member to short the pair of electrodes to each other when the lock arm is engaged with the lock projection, and contact points of the shorting member to touch the pair of electrodes and the lock projection are arranged along a direction perpendicular to a direction of fitting the first and second connector housings.

The connector system is further characterised in the connector system mentioned above in that one end portion of the shorting member is mounted on the main body and the other end portion of the shorting member is formed like a free end of a cantilever.

The connector system is further characterised in the connector system mentioned above in that the connector system further includes an interlocked-deforming mechanism positioning the shorting member to move apart from the pair of electrodes when the lock arm rides on the lock projection, and allowing the shorting member to touch the pair of electrodes when the lock arm is engaged with the lock projection.

The connector system is further characterised in the connector system mentioned above in that the second connector housing includes a rotating lever supported rotatably thereby so as to make the first connector housing near thereto by rotating the rotating lever, and the locking arm is supported by the rotating lever and the one end portion of the shorting member is mounted on the rotating lever.

The connector system is further characterised in the connector system mentioned above in that the lock arm is positioned outside the first connector housing when the lock arm is engaged with the lock projection.

The connector system is further characterised in the connector system mentioned above in that the lock arm includes a lock arm main body, one end of which is mounted on the main body and the other end of which is formed like a free end of a cantilever, and an unlock arm, one end of which is continued to the other end of the lock arm main body, and extends from the one end of the unlock arm toward the one end of the lock arm main body.

EFFECT OF THE INVENTION

According to the invention, since there are almost no position shifts between the shorting member, the contact point of one electrode and the lock projection along the direction of fitting connector housings, even if the shorting member is slightly deformed into the unexpected shape, the shorting member securely shorts the pair of electrodes to each other when the lock projection and the lock arm are engaged normally, and the shorting member does not shorts the pair of electrodes to each other when the lock projection and the lock arm are not engaged normally. Thereby, even if the shorting member is slight deformed, connection or disconnection of the connector housings is securely detected. Thus, connection of the connector housings to each other can be exactly detected.

According to the invention, since it can limit the shorting member to be affected when the lock arm is deformed, the shorting member can short securely the pair of electrodes to each other while the deformed lock arm is engaged with the lock projection. Therefore, when the lock arm is engaged with the lock projection even if the lock arm is deformed, a short break of the pair of electrodes caused by moving the shorting member apart from the pair of electrodes is prevented.

According to the invention, since the interlocked-deforming mechanism move the shorting member apart from the pair of electrodes when the lock arm rides on the lock projection, the shorting member does not short the pair of electrodes until the connector housings are completely fitted to each other.

Since the interlocked-deforming mechanism allows the shorting member to abut on the pair of electrodes when the lock arm is engaged with the lock projection, the shorting member can short the pair of electrodes when the connector housings are completely fitted to each other.

Thereby, the connection or disconnection of the connector housings can be securely detected.

According to the invention, the connector housings can be securely fitted and the pair of electrodes can be securely shorted with the shorting member by rotating the rotating lever.

According to the invention, since the first connector housing is not required to provide a space for the deformed lock arm inside thereof, large-sizing of the first connector housing is prevented. Without interference between the lock arm and round walls of the first connector housing, the connector housings can be securely fitted to each other.

According to the invention, since total length of the unlock arm can be elongated, a force for unlocking the engagement of the lock arm and the lock projection can be made smaller.

The above and other objects and features of this invention will become more apparent from the following description taken in conjunction with the accompanying drawings.

DESCRIPTION OF THE PREFERRED EMBODIMENT

Figure 1:
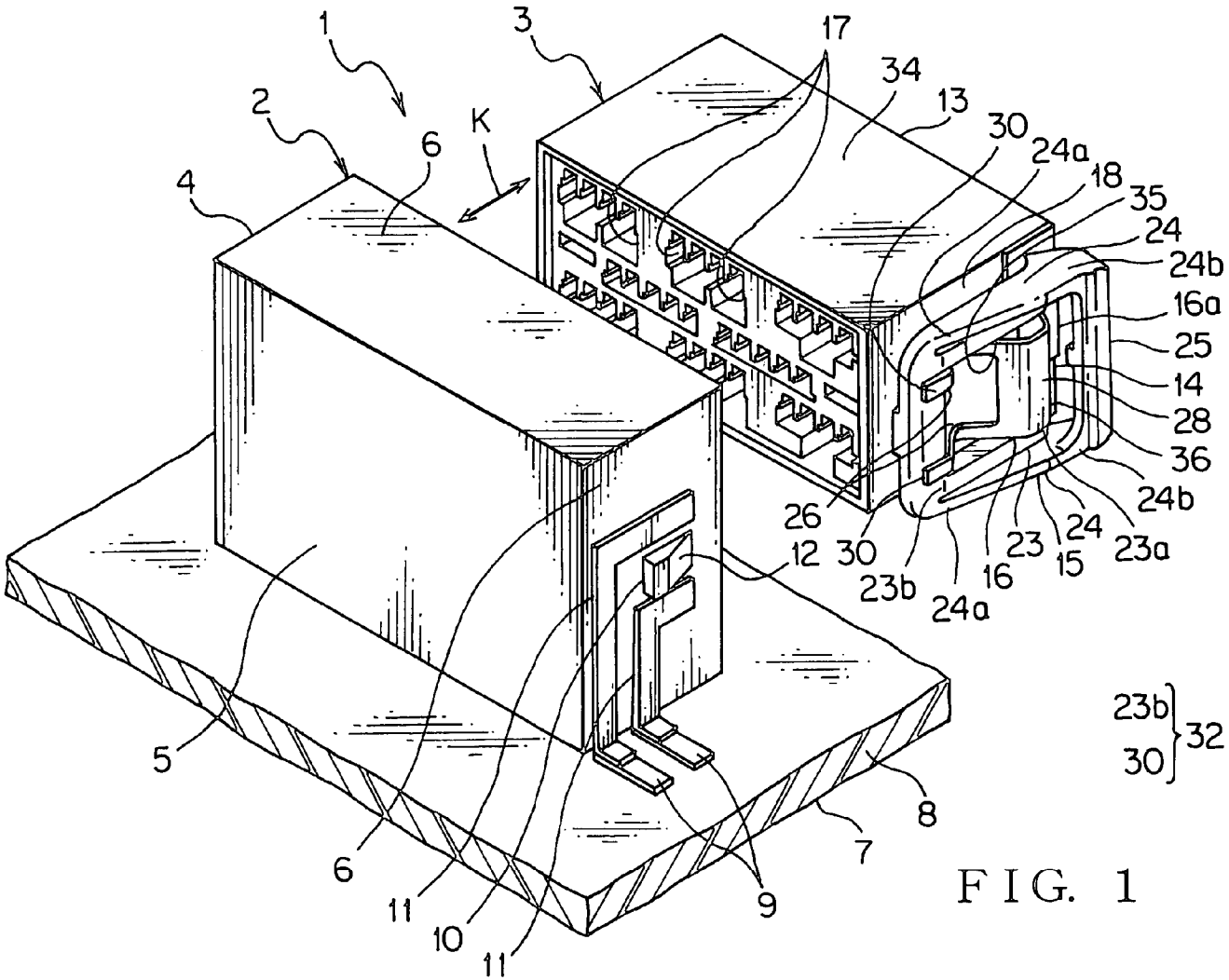
FIG. 1 is a perspective view of a connector system of a first embodiment according to the present invention.

A connector system of a first embodiment according to the present invention will be described with reference to FIGS. 1-6. The connector system 1 includes a first connector 2 and a second connector 3.

The first connector 2 has a first connector housing 4 and a terminal (not shown). The first connector housing 4 is made of insulating synthetic resin, and formed into a bottomed box shape with a bottom wall 5 and a plurality of surround walls 6 extending perpendicularly from outer edges of the bottom wall 5. The first connector housing 4 is mounted on a printed circuit board 7 so as to pile the one surround wall 6 on the printed circuit board 7.

The printed circuit board 7 has an insulating base board 8 and a conductive wiring pattern 9 formed on the base board 8 (a part of the wiring pattern 9 is shown in FIG. 1 and the other thereof is omitted). The wiring pattern 9 includes a connection detecting circuit for detecting whether or not the connectors 2, 3 are completely connected.

A lock projection 10 and a pair of electrodes 11 for detecting connection are provided on an outer surface of the first connector housing 4. The lock projection 10 is formed so as to project from an outer surface of the other one surround wall 6. The lock projection 10 has a taper surface 12 slanting against a fitting direction K (shown with an arrow in FIG. 1) of fitting connector housings 4, 13 of the connectors 2, 3 at a position corresponding to a second connector housing 13 of the second connector 3 so as to slant gradually toward outside of the first connector housing 4 interlockingly to be apart from the second connector housing 13 of the second connector 3.

The fitting direction K is a direction, in which the connector housings 4, 13 of the connectors 2, 3 approach to each other when the connector housings 4, 13 of the connectors 2, 3 are fitted to each other. The fitting direction K in FIG. 1 is in parallel to all of one edge line of a terminal located in the first connector housing 4, lengthwise of a female terminal received in the second connector housing 13 and lengthwise of an electric wire joined to the female connector.

The pair of electrodes 11 is made of a conductive metal and arranged in parallel to each other with a space. The pair of electrodes 11 is provided on the outer surface of the other one surround wall 6. In other words, the pair of electrodes 11 is exposed outside of the other one surround wall 6. The lock projection 10 is located between the pair of electrodes 11. The pair of electrodes 11 is connected to the wiring pattern 9 structuring the connection detecting circuit of the printed circuit board 7.

The terminal is formed into a bar shape with a conductive metal. One end portion of the terminal is located in the first connector housing 4, and the other end portion thereof projects out of the first connector housing 4 so as to be connected to the wiring pattern 9 of the printed circuit board 7. The terminal penetrates through the bottom wall 5.

The second connector 3 includes the second connector housing 13 and female terminals (not shown).

The second connector housing 13 has a main body 34, a part-mount portion 14, a lock arm 15 and a shorting member 16. The main body 34 is made of an insulating synthetic resin and formed into a rectangular box shape. The main body 34 includes a plurality of terminal receiving sections 17 for receiving the female terminal respectively.

The terminal receiving section 17 is a linear space arranged in the main body 34 so as to open both ends thereof at outer surfaces of the main body 34, that is the second connector housing 13. The plurality of terminal receiving sections 17 is arranged in parallel to each other. The main body 34, that is the second connector housing 13, penetrates into the first connector housing 4 and is connected with the first connector housing 4 when the lock arm is engaged with the lock projection 10.

The part-mount portion 14 is provided on one outer wall 18 of the main body 34 arranged along the fitting direction K, as shown in FIG. 1. The part-mount portion 14 is located in an edge area at a far side from the first connector housing 4 on the outer wall 18 of the main body 34.

Figure 3:
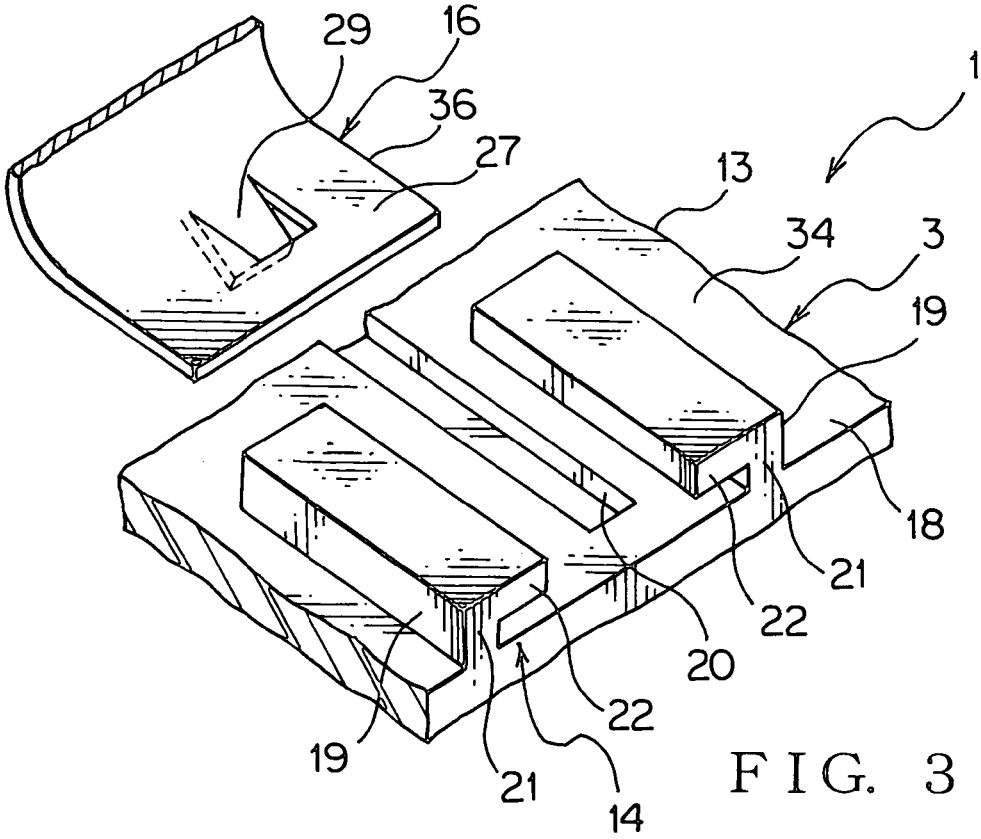
FIG. 3 is a perspective view of a part-mount portion of the connector system shown in FIG. 1.
Figure 4:
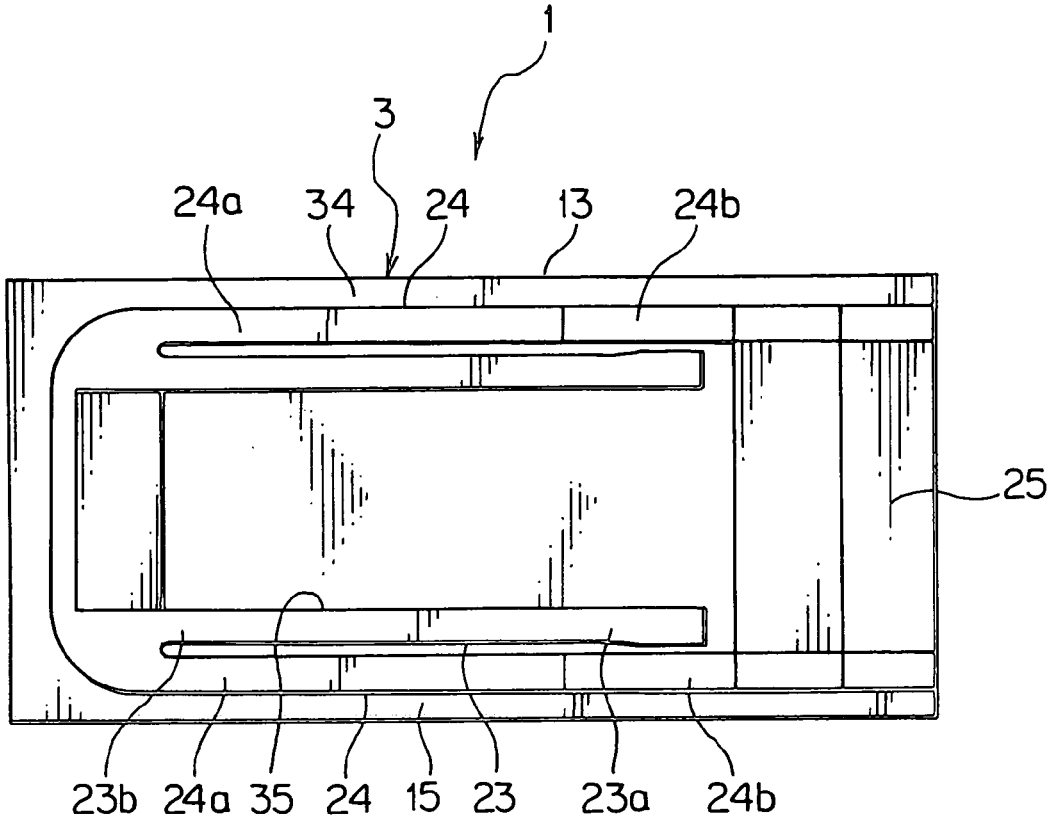
FIG. 4 is a side view of a lock arm of the connector system shown in FIG. 1.
Figure 5:
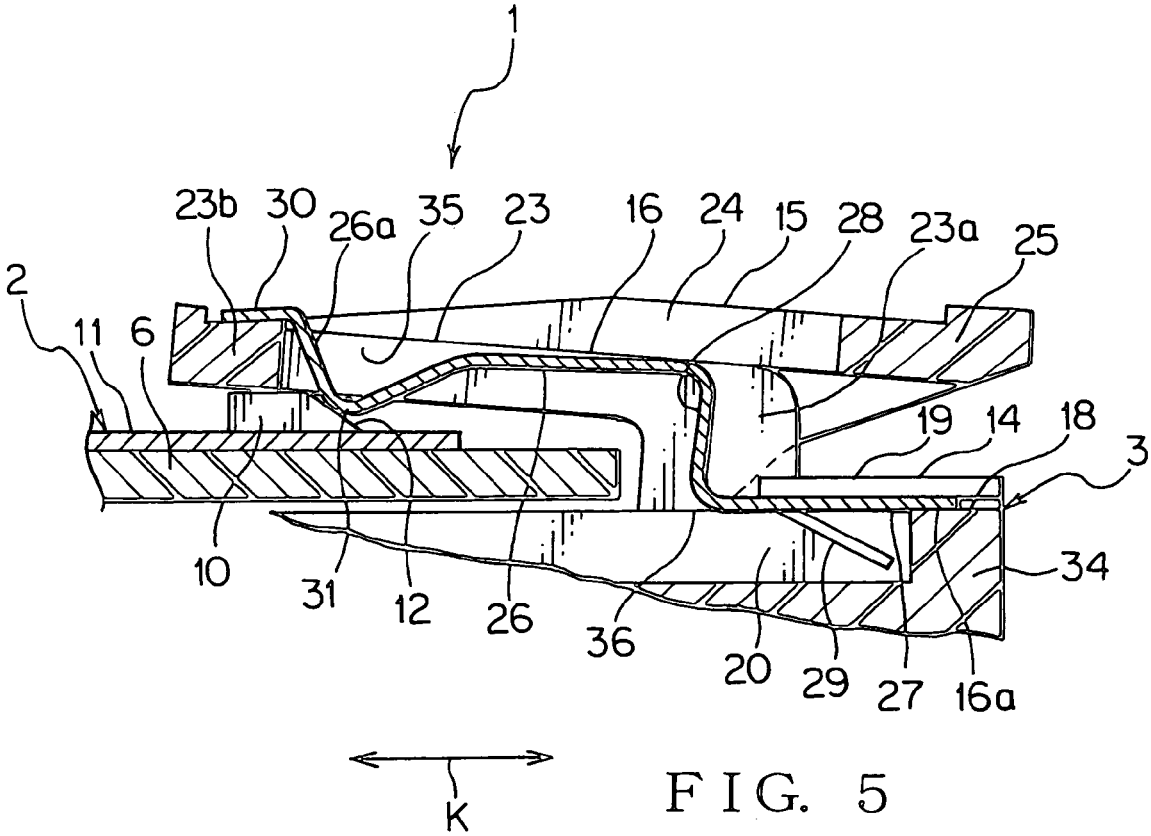
FIG. 5 is a cross sectional view showing a condition that the lock arm rides on a lock projection when fitting connector housings of the connector system shown in FIG. 1.

The part-mount portion 14 has a pair of rails 19 and an engaging groove 20 as shown in FIG. 3. The pair of rails 19 extends linearly and projects from the outer wall 18 of the main body 34. The rails 19 are arranged in parallel to each other and each lengthwise of the rails 19 are arranged in parallel to the fitting direction K. Each rail 19 integrally includes a vertical portion 21 projecting from the outer wall 18 of the main body 34 and an extending portion 22 extending from an edge portion of the vertical portion 21 at a far side from the outer wall 18 of the main body 34 so as to approach to each other.

The engaging groove 20 is formed so as to dent from the outer surface of the outer wall 18 of the main body 34, and extends linearly. The engaging groove 20 is arranged to make lengthwise thereof in parallel to the fitting direction K. The engaging groove 20 is located between the pair of rails 19.

The lock arm 15 is provided on the outer surface of the outer wall 18 of the main body 34. The lock arm 15 integrally includes a lock arm main body 23, a pair of unlock arms 24 and an unlock operating potion 25.

The lock arm main body 23 is formed into a band shape (arm shape) and lengthwise thereof is aligned along the fitting direction K. One end 23*a* of the lock arm 15 at far side from the first connector housing 4 is continued to the outer wall 18 of the main body 34. The other end 23*b* at near side of the first connector housing 4 is formed like a free end of a cantilever. Thus, the lock arm 15 is supported at the one end 23*a* thereof by the main body 34 of the second connector housing 13.

The lock arm main body 23 has a lock hole 35, which the lock projection 10 is positioned in and engaged with. When the lock arm main body 23, that is lock arm 15, rides on the lock projections 10, the lock arm 15 is elastically deformed so as to move the other end 23*b* apart from the first connector housing 4 until the lock projection 10 is positioned in the lock hole 35. When the lock projection 10 is positioned in the lock hole 35, the lock arm main body, that is the lock arm 15, is moved by an elastic restoring force back to a neutral position, in which the lock arm is not elastically deformed, and the other end 23*b* moves close to the first connector housing 4 so as to be positioned at an outside of the surround wall 6 of the first connector housing 4.

The pair of unlock arms 24 is formed into a bar shape so as to be in parallel to each other and locate the lock arm main body 23 therebetween. The unlock arms 24 is in parallel to the fitting direction K, that is the lock arm main body 23. One end 24*a* of the unlock arm 24 at the near side of the first connector housing 4 is continued to the other end 23*b* of the lock arm main body 23. The other end 24*b* of the unlock arm 24 at the far side of the first connector housing 4 is formed like a free end of cantilever. In other words, the unlock arm 24 extends from the one end 24*a* toward the one end 23*a* of the lock arm 23. The unlock operating portion 25 connects the other ends 24*b* of the unlock arm 24 to each other.

By positioning the lock projection 10 in the lock hole 35 provided at the lock arm main body 23, the lock arm 15 is engaged with the lock projection 10. When the lock arm main body 23 rides on the lock projections 10, the lock arm 15 is elastically deformed so as to move apart from the main body 34 of the second connector housing 13 until the lock projection 10 is positioned in the lock hole 35.

When the unlock operating portion 25 is pushed toward the main body 34 of the second connector housing 13, the lock arm 15 and the unlock arm 24 are moved together so as to move the lock arm main body 23 apart from the main body 34 of the second connector housing 13, so that the lock projection 10 moves out of the lock hole 35. Thus, by pushing the unlock operating portion 25 toward the main body 34 of the second connector housing 13, engagement of the lock arm 15 and the lock projection 10 is released.

Figure 2:
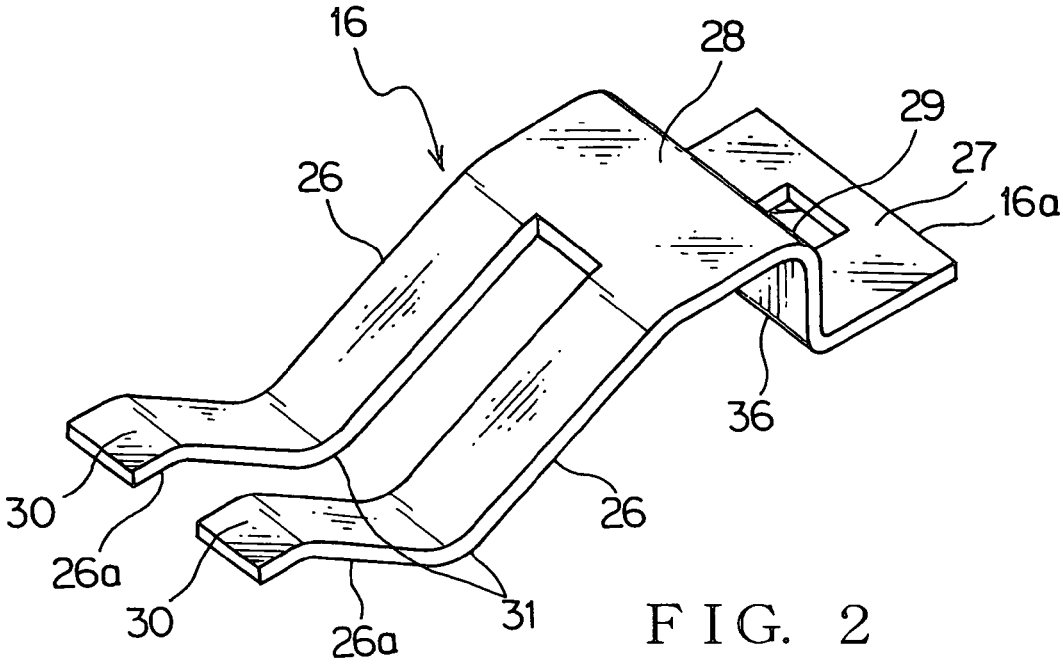
FIG. 2 is a perspective view of a shorting member of the connector system shown in FIG. 1.

The shorting member 16 is formed by bending a conductive sheet metal. The shorting member 16 includes a fixed portion 36 and a pair of contact elements 26 integrally as shown in FIG. 2.

The fixed portion 36 has a mount portion 27 with a rectangular shape in plan view and a connecting portion 28 extending from the mount portion 27 to be formed into an L-shape in side view. The mount portion 27 includes a lock piece 29. The lock piece 29 is formed by shearing a part of a plate structuring the mount portion 27 and bending it. The lock piece 29 is formed into a band shape, one end of which is continued to the mount portion 27 (extending vertically from the mount portion 27).

The mount portion 27 of the fixed portion 36, that is shorting member 16, is located between the extending portion 22 of the rail 19 of the part-mount portion 14 and the second connector housing 13 and between the vertical portion 21 of the pair of rails 19. The lock piece 29 penetrates into the engaging groove 20. Thus, the fixed portion 36 is mounted on the part-mount portion 14, that is the second connector housing 13. The one end portion 16*a* of the shorting member 16 is mounted on the second connector housing 13.

The pair of contact elements 26 is formed into band shape. The pair of contact elements 26 is arranged in parallel to each other. The one end portion of the pair of contact elements 26 is continued to the connecting portion 28. The contact element 26 includes a piling portion 30 at the other end 26*a* to pile on the other end 23*b* of the lock arm main body 23 of the lock arm 15 and a contact point 31 located at a near side from the piling portion 30 to one end of the contact element 26. The other end 26*a* of the contact element 26 corresponds to the other end of the shorting member 16.

The shorting member 16 is formed by bending so that the contact point 31 is positioned to project toward the outer surface of the second connector housing 13, and the piling portion 30 piles on the other end 23*b* of the lock arm main body 23 when the shorting member 16 is mounted on the part-mount portion 14.

When the mount portion 27 of the fixed portion 36 of the shorting member 16 is mounted on the part-mount portion 14, that is the second connector housing 13, the contact point 31 of the contact element 26 is positioned through the lock hole 35 of the lock arm main body 23 of the lock arm 15 at near side to the outer surface of the outer wall 18 of the second connector housing 13.

When the piling portion 30 arranged at the other end 26*a* of the shorting member 16 piles on the other end 23*b* of the lock arm main body 23 of the lock arm 15, the piling portion 30 is located outer than the other end 23*b* of the lock arm main body 23 against the second connector housing 13. Thus, the one end portion 16*a* of the shorting member 16 is mounted on the second connector housing 13 and the other end 26*a* is formed like the free end of the cantilever.

Before the connector housings 4, 13 are fitted to each other, the piling portion 30 of the shorting member 16 piles on the other end 23*b* of the lock arm main body 23 of the lock arm 15. When the connector housings 4, 13 are fitted to each other, contact points 31 of the contact elements 26 respectively abuts on the electrodes 11, and the piling portions 30 move up apart from the other end 23*b* of the lock arm main body 23. The contact points 31 of the pair of contact elements 26 of the shorting member 16 abut on the electrodes 11 so as to connect (short) electrically the pair of electrodes 11 to each other, so that the connection detecting circuit is formed as a closed circuit.

When the contact points 31 of the pair of contact elements 26 abut on the electrodes 11, the contact points 31 are arranged together with the lock projection 10 along the direction perpendicular to the fitting direction K. In other words, lengths of the contact elements 26 of the shorting member 16 are formed so that the contact points 31 abutting on the pair of electrodes 11 are arranged together with the lock projection 10 along the direction perpendicular to the fitting direction K when the lock arm 15 is engaged with the lock projection 10.

When the lock arm 15 rides on the lock projection 10, the other end 23*b* of the lock arm main body 23 and the piling portion 30 move the shorting member 16 apart from the pair of electrodes 11 in a direction that the other end 26*a* moves apart from the second connector housing 13. When the lock arm 15 is engaged with the lock projection 10, the other end 23*b* and the piling portion 30 move apart from each other to allow the contact points 31 of the shorting member 16 to abut on the pair of electrodes 11. The other end 23*b* and the piling portion 30 correspond to an interlocked-deforming mechanism 32. Thus, the connector system 1 includes the interlocked-deforming mechanism 32.

The female terminal is formed by bending a conductive metal sheet. The female terminal has a tubular electric contact portion and a wire connecting portion continued to the electric contact portion, and extends linearly. One end of the terminal penetrates into the electric contact portion so as to connect electrically and mechanically the one end, that is terminal, and the electric contact portion. The wire connecting portion is joined with an electric wire to connect electrically core of the wire and the female terminal. Thus, the female terminal connects the wire and the terminal electrically. Thereby, the wire and the wiring pattern 9 of the printed circuit board 7 are electrically connected.

For connecting the first connector 2 and the second connector 3 of the connector system 1 as structures above, the second connector housing 13 is corresponded to an opening of the first connector housing 4. The main body 34 of the second connector housing 13 is inserted gradually into the first connector housing 4. Thereby, the other end 23*b* of the lock arm 15 abuts on the lock projection 10.

When the main body 34 of the second connector housing 13 is inserted furthermore into the first connector housing 4, the other end 23*b* of the lock arm main body 23 of the lock arm 15 rides on the lock projection 10. The lock arm 15 is temporarily deformed elastically to move the other end 23*b* apart from the main body 34 of the second connector housing 13, and the piling portion 30 is pushed by the other end 23*b* of the lock arm main body 23, so that the shorting member 16 is temporarily deformed elastically so as to move the other end 26*a* apart from the main body 34 of the second connector housing 13.

Figure 6:
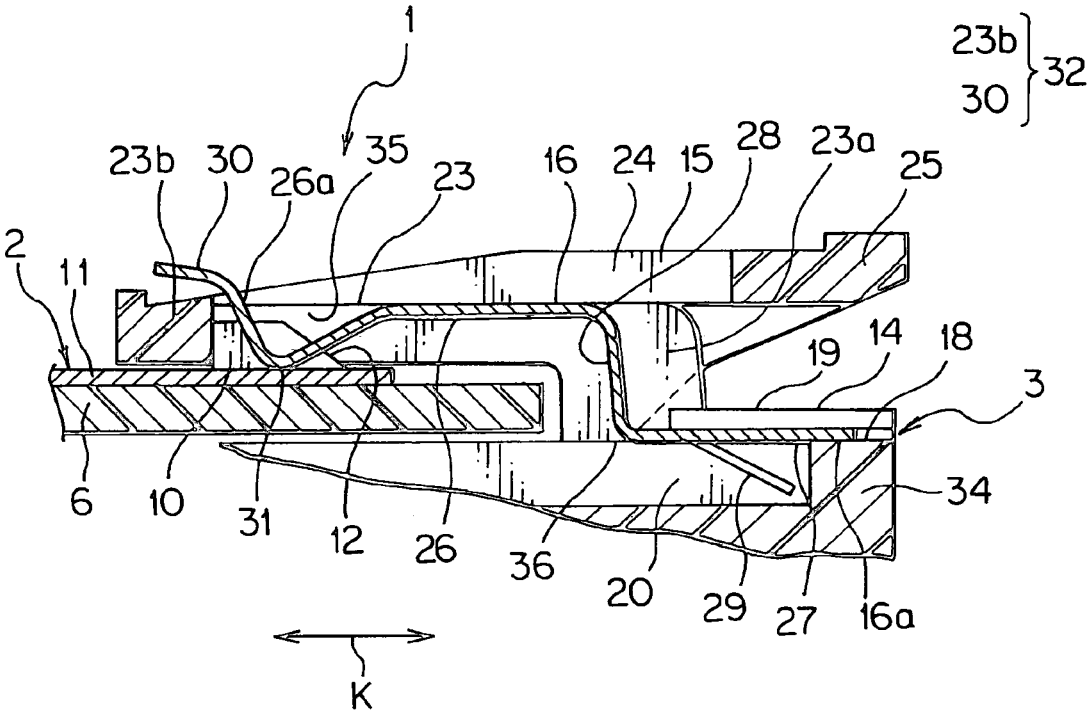
FIG. 6 is a cross sectional view showing a condition that the lock arm shown in FIG. 5 is engaged with the lock projection.

When the other end 23*b* of the lock arm main body 23 of the lock arm 15 goes over the lock projection 10 as shown in FIG. 6, the lock arm 15 is deformed to move the other end 23*b* close to the main body 34 of the second connector housing 13, and the shorting member 16 is moved by an elastic restoring force to move the other end 26*a* close to the main body 34 of the second connector housing 13. Thereby, the lock projection 10 is positioned in the lock hole 35, and the lock arm 15 is engaged with the lock projection 10. The lock arm 15 is located at the outside of the first connector housing 4. The contact points 31 of the shorting member 16 abut on the electrodes 11 to connect electrically the pair of electrodes 11 to each other. Thus, the connector housings 4, 13, that is the connectors 2, 3 are connected, and the connection detecting circuit detects connection of the connectors 2, 3.

According to the embodiment, the contact points 31 of the shorting member 16 corresponding to the electrodes 11 and the lock projection 10 are arranged along the direction perpendicular to the fitting direction K of fitting the connector housings 4, 13 to each other. Difference of distances of the contact points 31 and the lock projection 10 along the fitting direction K for fitting the connector housings 4, 13 is almost eliminated.

Therefore, even if the shorting member 16 is slightly deformed into an unexpected shape, when the lock projection 10 and the lock arm 15 are engaged normally, the shorting member 16 can securely short the pair of electrodes 11 to each other, and when the lock projection 10 and the lock arm 15 are not engaged normally, the shorting member 16 does not short the pair of electrodes 11 to each other. Thus, if the shorting member 16 is slight deformed, connection or disconnection of the connector housings 4, 13 to each other can be securely detected. Locking and detecting can be acted at the same timing. Therefore, connection of the connector housings 4, 13 can be exactly detected.

Since the shorting member 16 is mounted on the main body 34 of the second connector housing 13, even if the lock arm 15 is deformed, it is limited that the shorting member 16 is affected. In other words, the shorting member 16 is not affected by the lock arm 15, and can abut on the electrodes 11 at a stable contact pressure, so that short break of the pair of electrodes 11 by moving the shorting member 16 apart from the pair of electrodes 11 can be prevented.

Since the interlocked deforming mechanism 32 moves the shorting member 16 apart from the pair of electrodes 11 when the lock arm 15 rides on the lock projection 10, the shorting member 16 does not short the pair of electrodes 11 to each other until the connector housings 4, 13 are fitted completely to each other.

When the lock arm 15 is engaged with the lock projection 10, the interlocked deforming mechanism 32 allows the shorting member 16 to abut on the pair of electrodes 11. Thereby, when the connector housings 4, 13 are completely fitted to each other, the shorting member 16 shorts the pair of electrodes 11 to each other.

Therefore, the connection or disconnection of the connector housings 4, 13 can be securely detected.

Since the lock arm 15 is located at the outside of the first connector housing 4, a space for deforming the lock arm 15 is not required to be provided inside the first connector housing 4. Thereby, large-sizing of the first connector housing 4, that is the connector 1, is prevented.

The unlock arm 24 is continued to the other end 23*b* of the lock arm main body 23 of the lock arm 15 and extends from the other end 23*b* toward the one end 23*a*. Thereby, a total length of the unlock arm 24 can be elongated, and a force for releasing engagement between the lock arm 15 and the lock projection 10 can be reduced. Then, the engagement between the lock arm 15 and the lock projection 10 can be easily released.

A connector system of a second embodiment according to the present invention will be described with reference to FIGS. 7-9. The same parts as that of the first embodiment are given the same marking and description about that is omitted.

Figure 7:
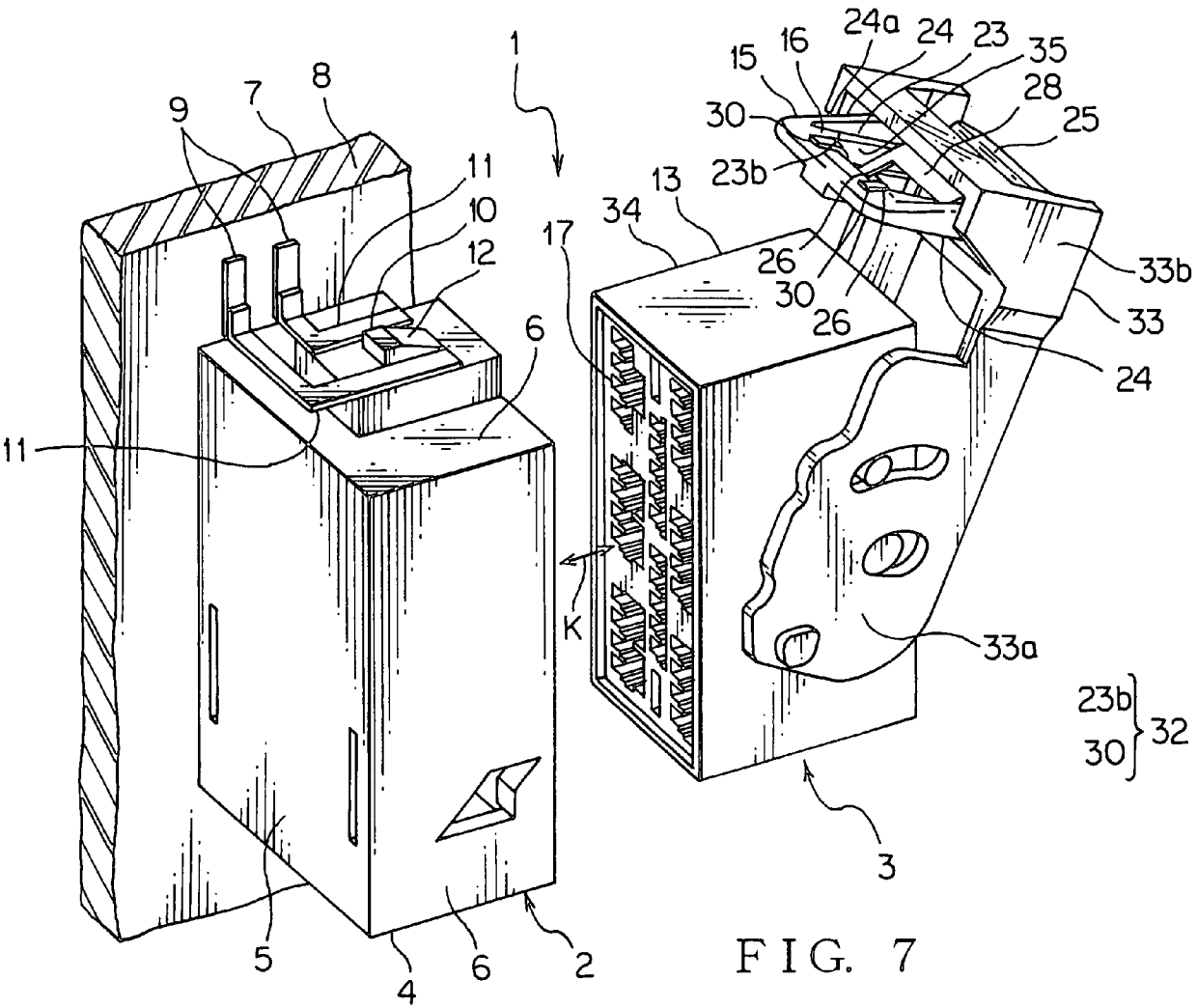
FIG. 7 is a perspective view of a connector system of a second embodiment according to the present invention.
Figure 8:
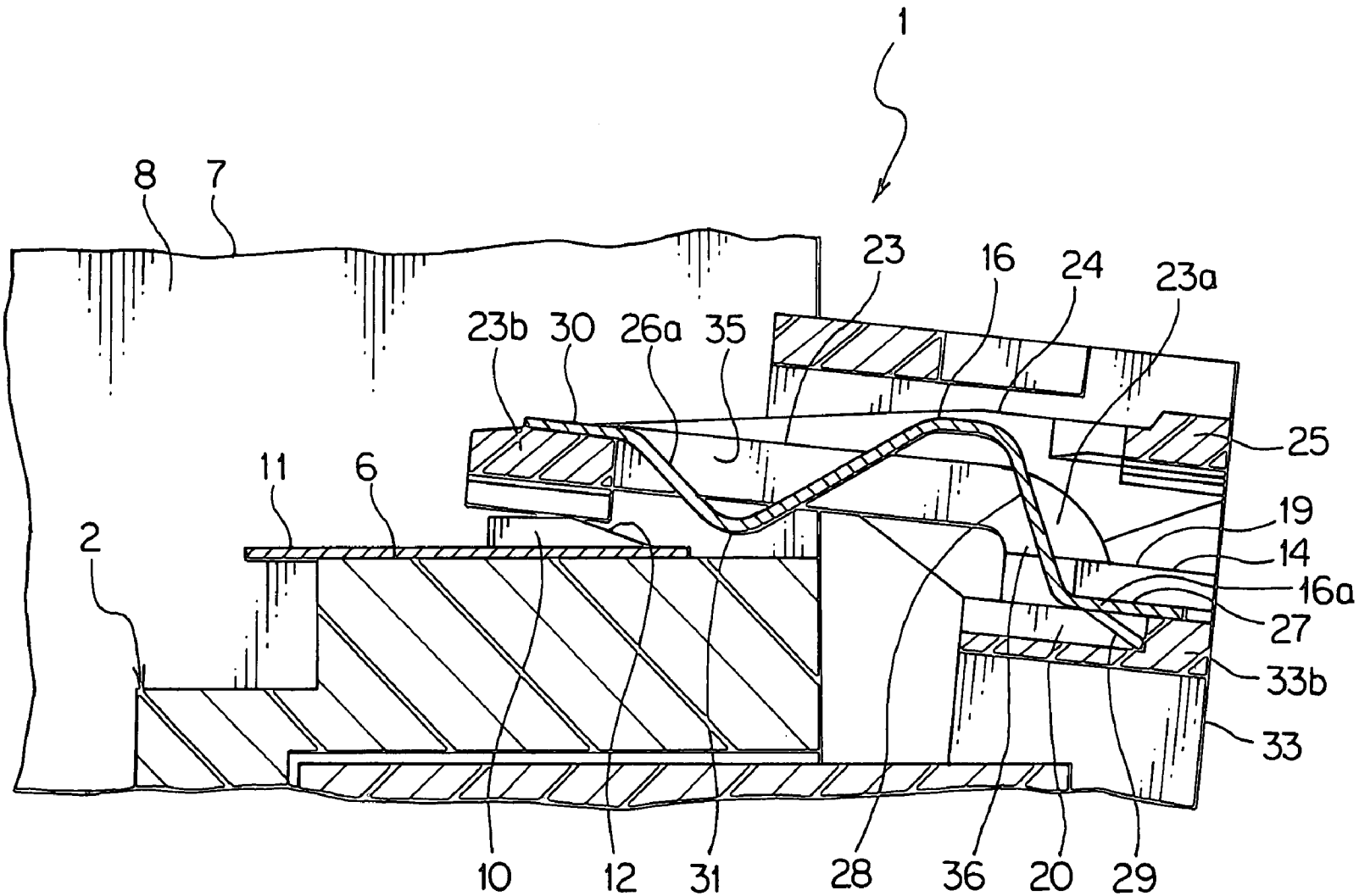
FIG. 8 is a cross sectional view showing a condition that the lock arm rides on a lock projection when fitting connector housings of the connector system shown in FIG. 7.
Figure 9:
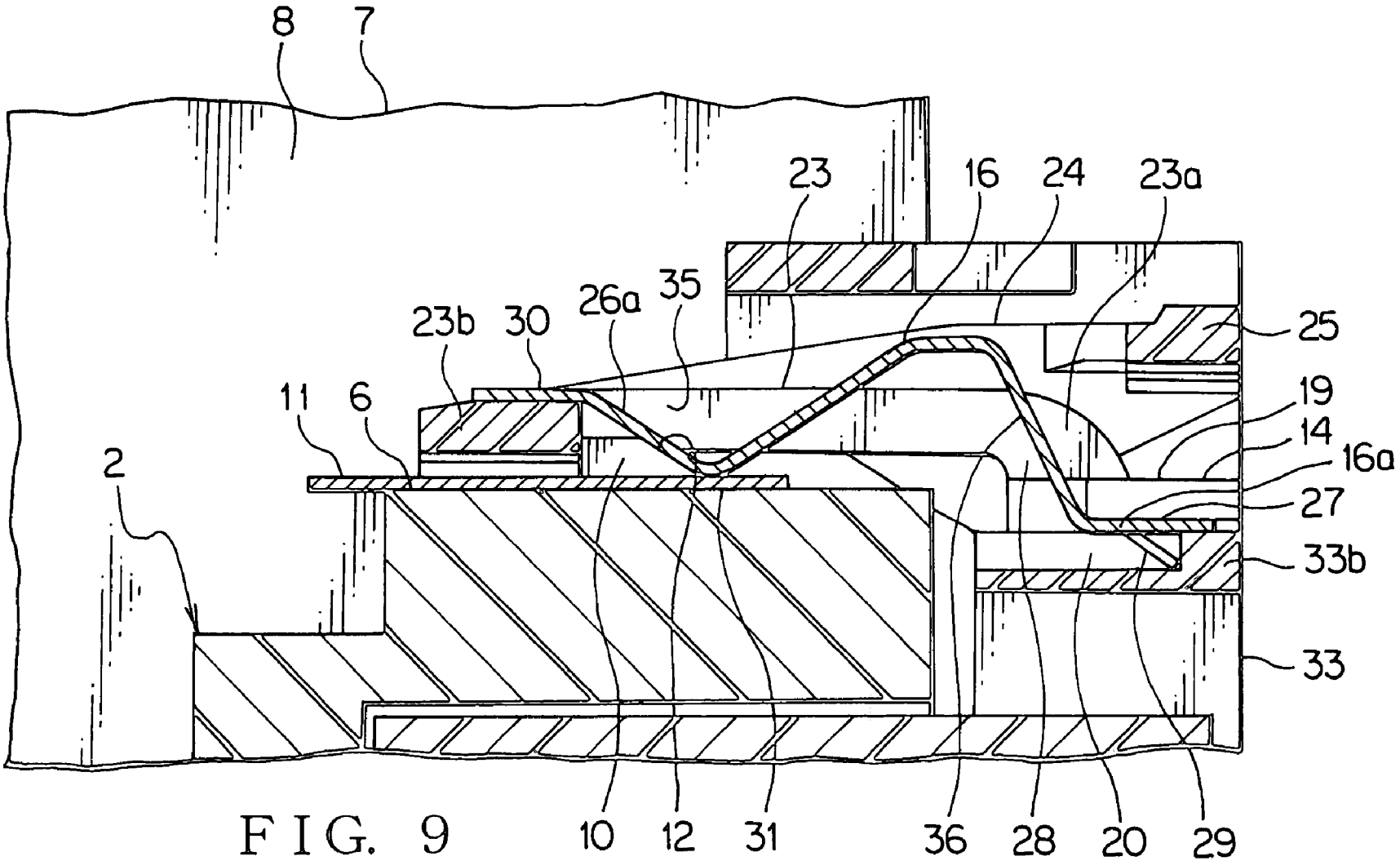
FIG. 9 is a cross sectional view showing a condition that the lock arm shown in FIG. 8 is engaged with the lock projection.

A second connector housing 13 of a second connector 3 of a connector system 1 according to this embodiment has a rotating lever 33 as shown in FIGS. 7-9. The rotating lever 33 is mounted rotatably about one end 33*a* on a main body 34 of the second connector housing 13 so as to move connector housings 4, 13 close to each other by rotating.

According to the embodiment, a part-mount portion 14 and a lock arm 15 are provided at the other end 33*b* of the rotating lever 33. In other words, one end portion 16*a* of a shorting member 16 is mounted on the rotating lever 33, and the lock arm 15 is supported by the rotating lever 33 in the embodiment. The one end portion 16*a* of the shorting member 16 is mounted on the rotating lever 33, and the other end portion is formed like a free end of a cantilever. In this embodiment, the rotating lever 33 corresponds to a main body.

As same as the first embodiment, when the lock arm 15 is engaged with a lock projection 10, the lock arm 15 is located outside the first connector housing 4. The lock arm 15 includes a lock arm main body 23 and an unlock arm 24 as same as the first embodiment.

For connecting a first connector 2 and the second connector 3 of the connector system 1 as structures above, the second connector housing 13 is corresponded to an opening of the first connector housing 4. A main body 34 of the second connector housing 13 is inserted into the first connector housing 4, and the rotating lever 33 is gradually rotated. Thereby, the main body 34 of the second connector housing 13 is inserted gradually into the first connector housing 4, and the other end 23*b* of the lock arm 15 abuts on the lock projection 10, as shown in FIG. 8.

When the main body 34 of the second connector housing 13 is inserted furthermore into the first connector housing 4 by rotating the rotating lever 33, the other end 23*b* of the lock arm main body 23 of the lock arm 15 rides on the lock projection 10. The lock arm 15 is temporarily deformed elastically to move the other end 23*b* apart from the main body 34 of the second connector housing 13, and a piling portion 30 is pushed by the other end 23*b* of the lock arm main body 23, so that the shorting member 16 is temporarily deformed elastically so as to move the other end 26*a* apart from the main body 34 of the second connector housing 13.

When the other end 23*b* of the lock arm main body 23 of the lock arm 15 goes over the lock projection 10 as shown in FIG. 9, the lock arm 15 is deformed to move the other end 23*b* close to the main body 34 of the second connector housing 13, and the shorting member 16 is moved by an elastic restoring force to move the other end 26*a* close to the main body 34 of the second connector housing 13. Thereby, the lock projection 10 is positioned in the lock hole 35, and the lock arm 15 is engaged with the lock projection 10. The lock arm 15 is located at the outside of the first connector housing 4. Contact points 31 of the shorting member 16 abut on the electrodes 11 to connect electrically the pair of electrodes 11 to each other. Thus, the connector housings 4, 13, that is the connectors 2, 3 are connected, and a connection detecting circuit detects connection of the connectors 2, 3.

According to this embodiment, since the lock arm 15 and one end portion 16*a* of the shorting member 16 are mounted on the rotating lever 33, in addition to the effects described in the first embodiment, by rotating the rotating lever 33, the connector housings 4, 13 can be securely fitted to each other with a small operating force (small inserting force), and the pair of electrodes 11 can be securely shorted with the shorting member 16.

Figure 10:
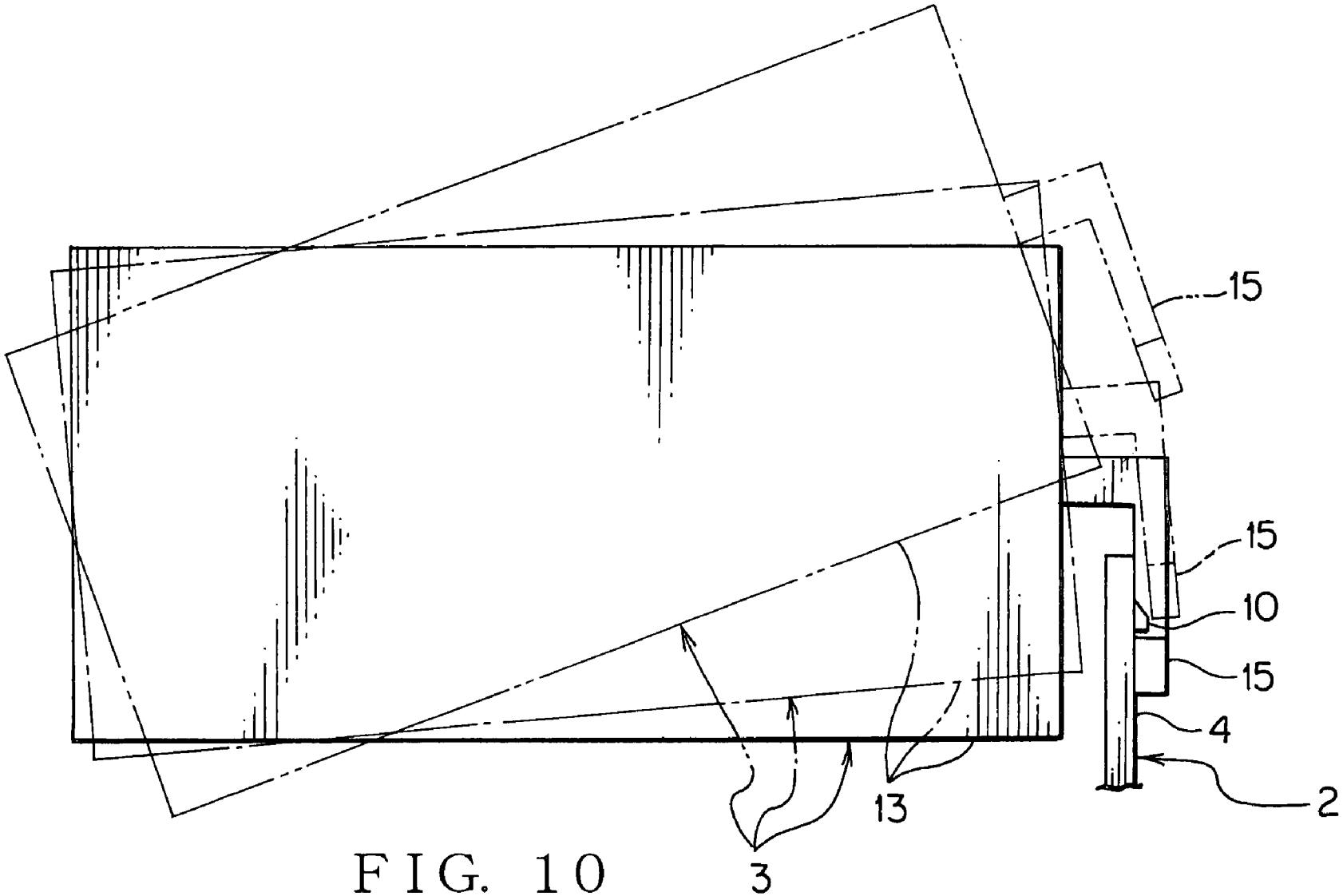
FIG. 10 is an illustrating view showing traces of the connectors according to the present invention, which are connected to each other.
Figure 11:
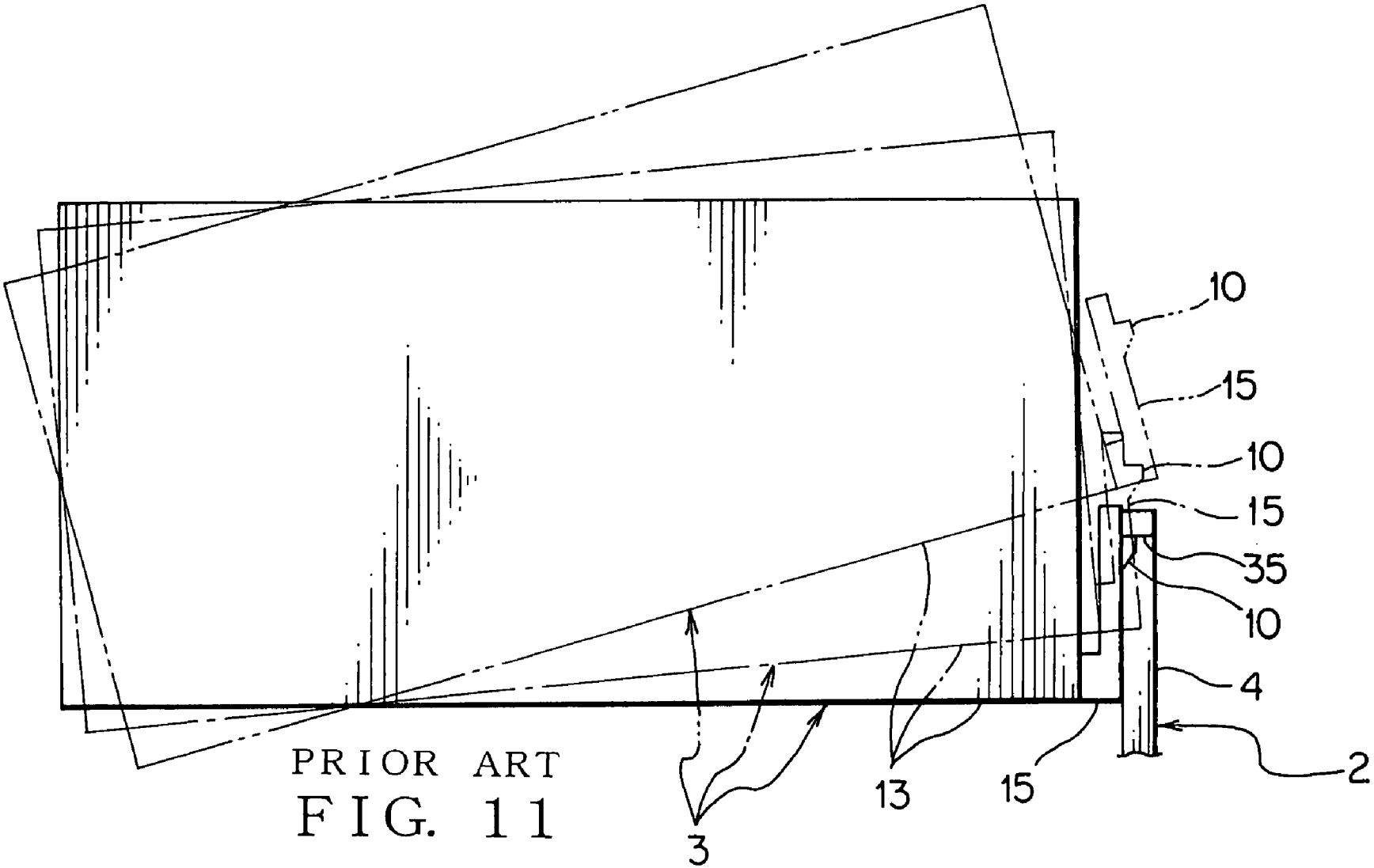
PRIOR ART FIG. 11
FIG. 11 is an illustrating view showing traces of the connectors as an example for comparing, which are connected to each other.

Effects of locating the lock arm 15, which is provided at the rotating lever 33 mounted on the second connector 3, outside the first connector housing 4 is evaluated. The result is shown in FIGS. 10, 11. FIG. 10 is an illustrated view of the second connector 3 of the connector system 1 according to the second embodiment. The second connector 3 moves in order at positions shown with a long dashed double-short dashed line and with a long dashed short dashed line in FIG. 10 against the first connector 2. When the second connector 3 is fitted with the first connector 2, the second connector 3 is positioned at a position shown with a solid line in FIG. 10.

FIG. 11 is an illustrating view showing an example for comparing, in which the lock projection 10 is provided at the lock arm 15, and the lock hole 35 is provided at the surround wall 6 of the first connector housing 4, and the lock arm 15 is located inside the first connector housing 4 after fitting the connector housings 4, 13 to each other. The second connector 3 moves in order at positions shown with a long dashed double-short dashed line and with a long dashed short dashed line in FIG. 11 against the first connector 2. When the second connector 3 is fitted with the first connector 2, the second connector 3 is positioned at a position shown with a solid line in FIG. 11.

In the example for comparing shown in FIG. 11, the lock arm 15 interferes with the surround wall 6 of the first connector housing 4, so that it is difficult to fit the connector housings 4, 13 to each other. In FIG. 10 showing the embodiment according to the present invention, the lock arm 15 does not interfere with the surround wall 6 of the first connector housing 4, so that it is allowable to fit the connector housings 4, 13 to each other securely. In the example shown in FIG. 11, only by sizing the first connector housing 4 larger than the embodiment of the present invention, the connector housings 4, 13 can be fitted to each other to eliminate interference between the lock arm 15 and the surround wall 6.

In the above embodiments, the shorting member 16 is formed like a cantilever to mount the one end portion 16*a* on the second connector housing 13 or the rotating lever 33. In the present invention, the shorting member 16 can be formed into any shapes to mount the second connector housing 13 or the rotating lever 33. In the present invention, the shorting member 16 can be mounted on for example the lock arm other than the second connector housing 13 or the rotating lever 33.

In the present invention, the lock arm 15 can be formed into a usual shape with T-shape cross section. In other words, the lock arm 15 can be formed into any shapes. In the present invention, the interlocked deforming mechanism 32 can be eliminated.

While, in the embodiment, the present invention is described, it is not limited thereto, and various change and modifications can be made with the scope of the present invention.

What is claimed is:

1. A connector system comprising:

a first connector housing having a pair of electrodes for detecting connection and a lock projection on a outer surface thereof; and a second connector housing fitting to the first connector housing, said second connector housing having a lock arm to be engaged with the lock projection, a main body supporting the lock arm and a shorting member to short the pair of electrodes to each other when the lock arm is engaged with the lock projection, wherein the lock arm is formed into a cantilever-shape, one end of which is continuous to the main body, and the other end of which is a free end, wherein one end portion of the shorting member is mounted on the main body, and the other end portion of the shorting member is formed like a free end of a cantilever and supported by the other end of the lock arm and moved to follow a motion of the lock arm, wherein, when contact points of the shorting member touch the pair of electrodes, the lock projection and the contact points are arranged along a direction perpendicular to a direction of fitting the first and second connector housings.

2. The connector system according to claim 1 farther comprising an interlocked-deforming mechanism positioning the shorting member to move apart from the pair of electrodes when the lock arm rides on the lock projection by inserting the second connector housing into the first connector housing, and allowing the shorting member to touch the pair of electrodes when the lock arm is engaged with the lock projection by further inserting the second connector housing into the first connector housing so as to move the lock arm over the lock projection.

3. The connector system according to claim 1, wherein the second connector housing includes a rotating lever supported rotatably thereby so as to make the first connector housing near thereto by rotating the rotating lever, and the lock arm is supported by the rotating lever and the one end portion of the shorting member is mounted on the rotating lever.

4. The connector system according to claim 1, wherein the lock arm is positioned outside the first connector housing when the lock arm is engaged with the lock projection.

5. The connector system according to claim 1, wherein the lock arm includes a lock arm main body, one end of which is mounted on the main body and the other end of which is formed like a free end of a cantilever, and an unlock arm, one end of which is continued to the other end of the lock arm main body, said unlock arm extending from said one end of the unlock arm toward the one end of the lock arm main body.

6. The connector system according to claim 4, wherein the lock arm includes a lock arm main body, one end of which is mounted on the main body and the other end of which is formed like a free end of a cantilever, and an unlock arm, one end of which is continued to the other end of the lock arm main body, said unlock arm extending from said one end of the unlock arm toward the one end of the lock arm main body.

* * * * *